US005388793A

United States Patent [19]

Kosten et al.

[11] Patent Number: 5,388,793

[45] Date of Patent: Feb. 14, 1995

[54] SUPPORT SYSTEM FOR KITCHEN APPLIANCE

[75] Inventors: Richard B. Kosten, West Haven; Charles Z. Krasznai, Fairfield, both of Conn.

[73] Assignee: Black & Decker Inc., Newark, Del.

[21] Appl. No.: 178,973

[22] Filed: Jan. 7, 1994

[51] Int. Cl.[6] ..... F16M 11/00

[52] U.S. Cl. ..... 248/201; 219/386; 248/675; 312/246

[58] Field of Search ..... 248/201, 675, 317, 309.1; 219/385, 386, 387; 312/245, 246; 99/385; 126/273 A

[56] References Cited

U.S. PATENT DOCUMENTS

| | | | |
|---|---|---|---|
| 4,313,043 | 1/1982 | White et al. | 248/674 X |
| 4,540,146 | 9/1985 | Basile | 248/201 |
| 4,580,754 | 4/1986 | Hughes | 248/201 X |
| 4,628,185 | 12/1986 | Norwood et al. | 219/386 |
| 4,630,532 | 12/1986 | Sonnentag et al. | 248/201 X |
| 4,635,615 | 1/1987 | Itoh et al. | 312/245 X |
| 4,645,909 | 2/1987 | Thoben et al. | 219/385 X |
| 4,666,113 | 5/1987 | Itoh et al. | 248/201 |
| 4,720,622 | 1/1988 | Iwata et al. | 312/245 X |
| 4,792,195 | 12/1988 | Adriaansen et al. | 312/245 X |

*Primary Examiner*—Ramon O. Ramirez

*Attorney, Agent, or Firm*—Barry E. Deutsch

[57] ABSTRACT

A support system for suspending a kitchen appliance from the bottom surface of a kitchen cabinet includes a pair of horizontally spaced mounting brackets connected to the bottom surface of the kitchen cabinet. Each bracket includes a plurality of vertically spaced horizontally extending ribs. Each of the ribs includes a trailing edge and a leading edge. Each leading edge includes a first vertically extending wall and each trailing edge includes a second vertically extending wall. Adjacent pairs of ribs define therebetween a horizontally extending slot. The kitchen appliance includes a housing having sidewalls. Each sidewall includes a handle-like member extending horizontally towards the rear wall of the kitchen appliance. The member includes a leading edge and a trailing edge. Each trailing edge includes a vertically extending wall which abuts the first vertically extending wall of one of the ribs when the member is placed in the slot defined between adjacent ribs.

10 Claims, 1 Drawing Sheet

SUPPORT SYSTEM FOR KITCHEN APPLIANCE

BACKGROUND OF THE INVENTION

FIELD OF THE INVENTION

This invention relates to a support system for suspending a kitchen appliance from the bottom surface of a kitchen cabinet and more specifically to such a support system which simplifies the installation of a kitchen appliance underneath a kitchen cabinet.

As shown in U.S. Pat. No. 4,628,185, assigned to the same assignee as the assignee of the present invention, it is known to suspend kitchen appliances, such as electric toasters, directly under the kitchen cabinetry to provide additional counter space. Other patents which disclose support systems for mounting a kitchen appliance under a kitchen cabinet are U.S. Pat. Nos. 4,580,853 and 4,753,406.

The suspension system disclosed in U.S. Pat. No. 4,580,853 requires the utilization of a bracket plate which is adjustably secured to a pair of hanger brackets. The hanger brackets are, in turn, bolted to the bottom of the kitchen cabinet.

U.S. Pat. No. 4,628,185 discloses an arrangement for suspending a toaster oven beneath a kitchen cabinet which require special plastic spacers for adjustably suspending the appliance. The appliance is joined to a hood which in turn is suspended from the kitchen cabinet. U.S. Pat. No. 4,753,406 discloses a metal plate adapted to be placed on a bottom panel of a kitchen cabinet. A hook extends downwardly from the metal plate through the bottom panel of the kitchen cabinet. A bracket includes a hook retaining hole for retaining the hook. An adjustment bolt and an adjustment nut threaded over the adjustment bolt engages the bracket. A reinforcing attachment plate includes a boss for engaging the adjustment bolt.

The foregoing patents are illustrative of the various complex arrangements heretofore used for suspending a kitchen appliance from a kitchen cabinet. These prior art arrangements comprise numerous parts which results in rather difficult installation.

It is accordingly an object of this invention to suspend a kitchen appliance from the under surface of a kitchen cabinet through the use of relatively few components which makes the installation relatively simple and not time consuming. Features such as simple installation in a relatively short duration of time are particularly desired by the do-it-yourself consumer.

SUMMARY OF THE INVENTION

The foregoing object and other objects of the invention are attained in a support system for suspending a kitchen appliance from the bottom surface of a kitchen cabinet including a pair of horizontally spaced mounting brackets connected to the bottom surface of the cabinet. Each bracket includes a plurality of vertically spaced horizontally extending ribs. Each of the ribs include a leading edge and a trailing edge. Each leading edge includes a first vertically extending wall and each trailing edge includes a second vertically extending wall. Adjacent pairs of ribs define therebetween a horizontally extending slot. The kitchen appliance includes a housing having sidewalls. Each sidewall includes a handle-like member extending horizontally towards the rear wall of the kitchen appliance. The member includes a leading edge and a trailing edge. The trailing edge includes a first vertically extending wall which abuts the first vertically extending wall of one of the ribs when the handle-like member is placed in the slot defined between adjacent ribs. In a preferred embodiment the handle-like member includes a second vertically extending wall which abuts the leading end of the other of the ribs defining the slot.

DESCRIPTION OF THE PREFERRED EMBODIMENT

Figure 1:
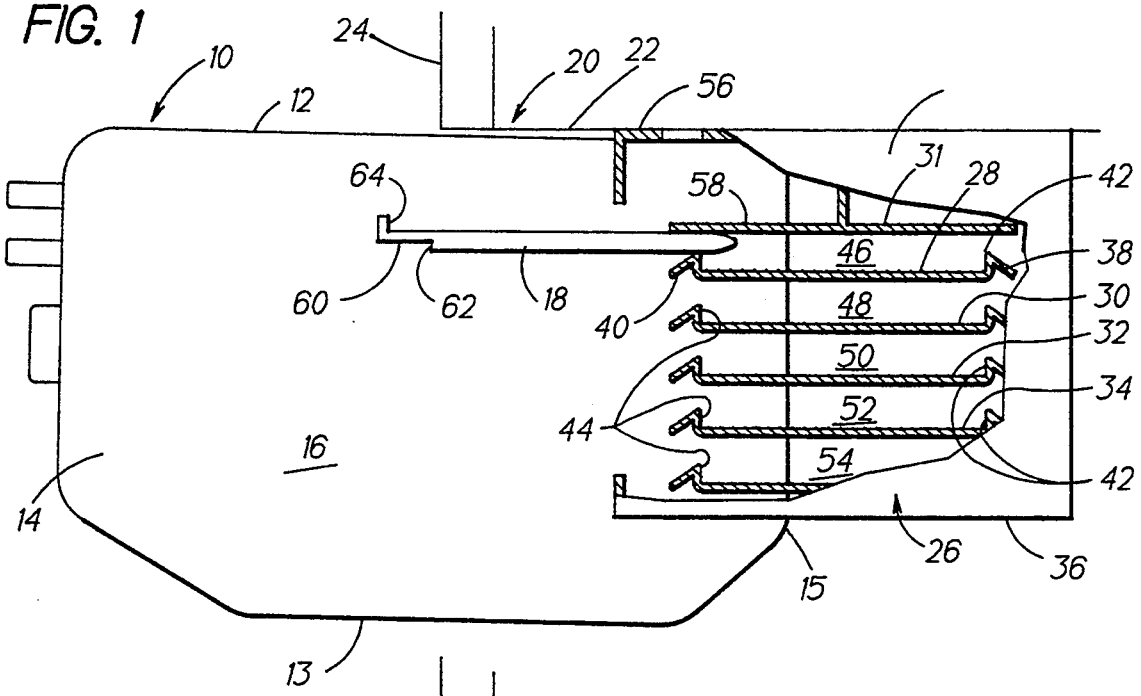
FIG. 1 is an end view, partially in cross section, illustrating an appliance such as a toaster being mounted in a support bracket of the support system of the present invention.

Referring now to the various figures of the drawing, there is disclosed a preferred embodiment of the present invention. In referring to the various figures, like numerals shall refer to like parts.

Figure 2:
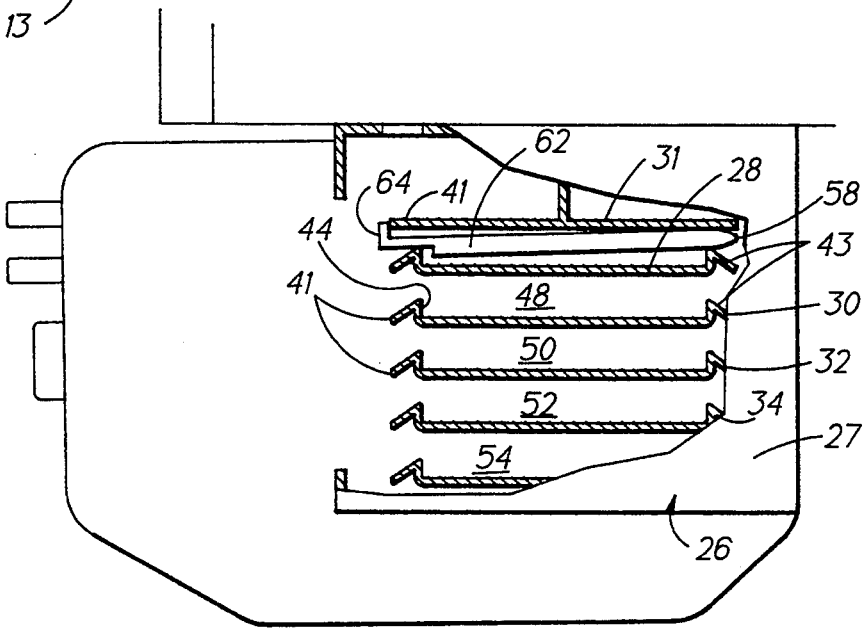
FIG. 2 is a view similar to that shown in FIG. 1 with the appliance fully mounted within the support bracket.

As is known, it is sometimes desirable to suspend a kitchen appliance, such as a toaster, from the lower surface of a kitchen cabinet to conserve kitchen counter space. As shown in FIGS. 1 and 2, a kitchen appliance such as toaster 10 is suspended from the lower surface 22 of a kitchen cabinet 20 having a front wall or door 24. Toaster 10 includes a top wall 12, a bottom wall 13, rear wall 15, front wall 14 which in the preferred embodiment is a pivotable door, and opposed side walls 16 (only one of which is shown).

A handle-like member 18 is formed on the outer face of each side wall 16. Handle-like member 18 extends in a substantially horizontal plane. In a preferred embodiment member 18 is slightly canted upwardly by about a 3° angle from its trailing end 60 to its forward end 58. The reason for canting the handle-like member at a 3° angle shall be more fully explained hereinafter.

Handle-like member 18, in addition to leading end 58 and trailing end 60 includes a first vertical wall 62 and a second vertical wall 64 spaced from the first wall. Wall 62 faces the front 14 of the toaster and extends towards the bottom wall 13, while wall 64 faces rear wall 15 of toaster 10 and extends towards top wall 12 thereof. The forward edge of end 58 is preferably tapered to reduce the thickness of the end.

Figure 3:
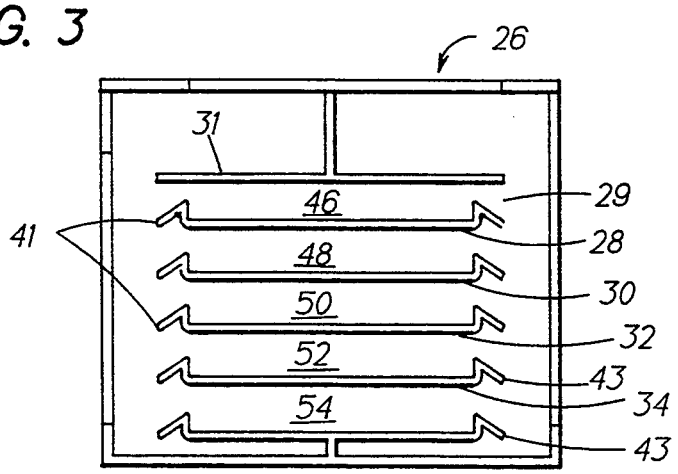
FIG. 3 is an elevational side view of the mounting bracket of the support system of the present invention.

The support system for the kitchen appliance includes a pair of support brackets 26 (only one of which is shown) which is attached to the lower surface of bottom wall 22 of kitchen cabinet 20. As shown in FIGS. 1 and 2 support bracket 26 includes a frame member 36 having an outer face 27 and as shown in FIG. 3 an inside face 29. Inside face 29 is in spaced relation from side wall 16 of appliance 10. It should be understood that while only one mounting bracket 26 is illustrated, the support system of the present invention employs an identical mounting bracket attached to the other side wall 16 of the appliance. Inside face 29 includes a plurality of identical vertically spaced ribs 28, 30, 32 and 34. The ribs are vertically spaced along the vertical plane of wall 29.

A generally planar rib 31 is vertically spaced above rib 28. Rib 31 need not be the same configuration as the remaining ribs as shall be more fully understood hereinafter. The number of ribs employed on support bracket 26 may be varied without departing from the spirit of the invention.

The vertically spaced ribs define therebetween horizontally extending slots, 46,48, 50, 52 and 54. Each of the identical ribs 28, 30, 32 and 34 includes a leading edge 41 and a trailing edge 43.

The leading edge 41 of each rib includes an inclined surface 40 which terminates in a vertically extending wall 44. Each trailing edge 43 of the identical ribs includes upstanding wall 42 which faces vertical wall 44 of leading edge 41. An inclined surface 38 extends downwardly from each vertical wall 42.

In actual use as shown in FIG. 1, the leading end 58 of handle-like member 18 is inserted into one of the slots (for example slot 46) formed between adjacent ribs 31 and 28. The upwardly inclined surface 40 of leading edge 41 of each rib guides the handle-like member into the slot. The slight inclination given to the handle-like member, for example 3°, enables the installer to readily insert handle-like member into the selected one slot. The tapered edge of end 58 also aides in the insertion of member 18 into the desired slot. If the installer desires to have a relatively small space between the top wall 12 and bottom wall 22 of cabinet 20, then the handle-like member will be inserted into slot 46. If the user desires a relatively large space between the opposed surfaces 12 and 22, then the user will insert handle-like member 18 into slot 54. Slots 48, 50 and 52 provide intermediate adjustment capabilities for positioning the top of the toaster relative to the bottom surface of kitchen cabinet 20.

With specific reference to FIG. 2, it will be noted that when handle-like member 18 is inserted completely within the slot so that leading end 58 of member 18 is adjacent trailing edge 43 of the rib defining the slot, wall 64 of handle-like member 18 engages the end of the leading edge 41 of the rib defining the top of the slot. Further, it will be noted that wall 62 of handle-like member is in abutting relation with wall 44 of the rib defining the bottom of the slot. The engagement of wall 64 with the end of the leading edge 41 of the rib limits further relative movement of toaster 10 towards the trailing edge 43 of the rib and the rear wall (not shown) of the kitchen cabinet. Likewise, the abutting relationship of walls 44 and 62 prevent unwanted relative movement of the toaster towards the leading edge 41 of the rib and the front 24 of the kitchen cabinet. In the preferred embodiment, there is a slight space provided between the walls 44 and 62 and an additional space provided between the top of handle-like member 18 and the bottom face of the rib positioned at the top of the slot. These spaces enable the user to raise the toaster upwardly relative to mounting bracket 26 to remove the toaster from the mounting bracket.

The support system for the kitchen appliance of the present invention enables the installer to quickly suspend the kitchen appliance from the bottom surface of a kitchen cabinet. The support system of the present invention also enables the installer to readily adjust the position of the appliance relative to the lower surface of the kitchen cabinet.

While a preferred embodiment of the present invention has been described and illustrated the invention should not be limited thereto but may be otherwise embodied within the scope of the following claims.

What is claimed is:

1. A kitchen appliance having a support system for suspending the kitchen appliance from the bottom surface of a kitchen cabinet comprising:

a pair of horizontally spaced mounting brackets connected to the bottom surface of the kitchen cabinet, each bracket including a plurality of vertically spaced horizontally extending ribs, each of the ribs including a leading edge and a trailing edge, each leading edge including a first vertically extending wall, adjacent pairs of ribs defining therebetween a horizontally extending slot; and said kitchen appliance including a housing having sidewalls, each sidewall including a handle-like member extending horizontally towards a rear wall of the kitchen appliance, said member including a leading edge and a trailing edge, said trailing edge of said member including a second vertically extending wall, the second vertically extending wall abutting the first vertically extending wall of one of the ribs when the handle-like member is placed in the slot defined between adjacent ribs.

2. A support system in accordance with claim 1 including means defining a ramp formed at the leading edge of each of the horizontally extending ribs.

3. A support system according to claim 2 wherein the trailing edge of each rib includes a third vertically extending wall.

4. A support system according to claim 3 wherein the leading edge of the handle-like member is tapered to reduce the thickness of the end of the leading edge.

5. A support system according to claim 1 wherein the trailing edge of each rib includes a third vertically extending wall.

6. A support system according to claim 5 wherein the leading edge of the handle-like member is tapered to reduce the thickness of the end of the leading edge.

7. A support system according to claim 1 wherein the leading edge of the handle-like member is tapered to reduce the thickness of the end of the leading edge.

8. A support system in accordance with claim 1 wherein the trailing edge of the handle-like member includes a fourth vertically extending wall which abuts the end of the leading edge of the other of the ribs defining the slot.

9. A kitchen appliance having a support system for suspending the kitchen appliance from the bottom surface of a kitchen cabinet having front and rear walls comprising:

a pair of horizontally spaced mounting brackets connected to the bottom surface of the kitchen cabinet, each bracket including a plurality of vertically spaced horizontally extending ribs, with adjacent ribs defining horizontally extending slots therebetween;

said kitchen appliance including a housing having front, rear and side walls, each sidewall including a handle-like member extending horizontally toward the rear wall of the kitchen appliance, said member including a leading edge and a trailing edge; and said ribs and said handle-like member including cooperating means to limit movement of the kitchen appliance towards the rear wall and towards the front wall of the kitchen cabinet when the handle-like member is inserted into a selected one slot formed between adjacent ribs.

10. A support system according to claim 9 wherein the leading edge of the handle-like member is tapered to reduce the thickness of the end of the leading edge.

* * * * *